US009080803B2

(12) United States Patent
Wheeland et al.

(10) Patent No.: US 9,080,803 B2
(45) Date of Patent: Jul. 14, 2015

(54) METHOD AND DEVICE FOR RAPIDLY COOLING LIQUIDS

(71) Applicant: Turbo Innovations, LLC, San Diego, CA (US)

(72) Inventors: Jeffrey Wheeland, San Diego, CA (US); Aleksei Naumov, San Diego, CA (US); Nicola Hedge, San Diego, CA (US); Georgy Ivanovich Naumov, St. Petersburg (RU)

(73) Assignee: TURBO INNOVATIONS, LLC, San Diego, CA (US)

( * ) Notice: Subject to any disclaimer, the term of this patent is extended or adjusted under 35 U.S.C. 154(b) by 197 days.

(21) Appl. No.: 13/764,644

(22) Filed: Feb. 11, 2013

(65) Prior Publication Data

US 2013/0206779 A1 Aug. 15, 2013

Related U.S. Application Data

(60) Provisional application No. 61/597,228, filed on Feb. 10, 2012.

(51) Int. Cl.
*F25D 11/00* (2006.01)
*F25D 3/08* (2006.01)

(52) U.S. Cl.
CPC *F25D 11/00* (2013.01); *F25D 3/08* (2013.01); *F25D 2303/081* (2013.01); *F25D 2303/0831* (2013.01); *F25D 2303/0841* (2013.01); *F25D 2331/803* (2013.01); *F25D 2331/805* (2013.01)

(58) Field of Classification Search
CPC ..... F25D 3/08; F25D 11/00; F25D 2303/081; F25D 2303/0831; F25D 2303/0841; F25D 2331/803; F25D 2331/805
USPC ..... 62/389, 457.3, 457.4, 487.8; 220/592.16, 592.17
See application file for complete search history.

(56) References Cited

U.S. PATENT DOCUMENTS

| | | | | |
|---|---|---|---|---|
| 136,632 | A * | 3/1873 | Whipple | 366/213 |
| 1,421,932 | A * | 7/1922 | Foster | 185/39 |
| 2,216,762 | A * | 10/1940 | Bolas | 62/381 |
| 2,838,916 | A * | 6/1958 | Sola | 62/336 |
| 4,078,397 | A * | 3/1978 | Brande | 62/372 |
| 4,164,851 | A * | 8/1979 | Bryant | 62/381 |
| 4,741,174 | A * | 5/1988 | Uesaka | 62/342 |
| 4,813,243 | A | 3/1989 | Woods et al. | |
| 4,825,665 | A * | 5/1989 | Micallef | 62/372 |
| 5,005,378 | A * | 4/1991 | Ottenheimer | 62/378 |
| 5,125,243 | A * | 6/1992 | Zorea et al. | 62/446 |
| 5,282,368 | A | 2/1994 | Ordoukhanian | |
| 5,992,309 | A | 11/1999 | Mulhauser et al. | |
| 6,314,751 | B1 | 11/2001 | Gjersvik | |
| 7,100,393 | B2 * | 9/2006 | D'Angelo | 62/372 |
| 7,174,723 | B2 * | 2/2007 | Molfese | 62/62 |
| 2001/0036124 | A1 * | 11/2001 | Rubenstein | 366/205 |
| 2004/0144103 | A1 * | 7/2004 | Lee et al. | 62/62 |
| 2006/0185372 | A1 * | 8/2006 | Conde Hinojosa | 62/64 |
| 2007/0065312 | A1 * | 3/2007 | Whitehouse et al. | 417/420 |
| 2008/0141702 | A1 * | 6/2008 | Gagliano et al. | 62/389 |

* cited by examiner

*Primary Examiner* — Mohammad M Ali
(74) *Attorney, Agent, or Firm* — Wilson Sonsini Goodrich & Rosati

(57) ABSTRACT

A method and device comprising a cooling chamber and a rotating portion located inside said chamber whereby a beverage container is attached frictionally to said rotating portion and is spun inside the cooling chamber whereby ice and water or other cooling means are employed to chill the exterior walls of a beverage container. Rotation is achieved by a manual operation of a spring-plunger spinning means and causes suitable chilling in a reasonable period of time without electrical power.

20 Claims, 3 Drawing Sheets

METHOD AND DEVICE FOR RAPIDLY COOLING LIQUIDS

CROSS REFERENCE TO RELATED APPLICATIONS

The present application for a Nonprovisional Patent depends from Provisional Patent Application No. 61/597,228 entitled "Method and Device for Rapidly Cooling Liquids".

STATEMENT REGARDING FEDERALLY SPONSORED RESEARCH OR DEVELOPMENT

Not Applicable.

BACKGROUND OF THE INVENTION

1. Field of the Invention

The present invention relates to devices that are used to cool liquids. More specifically, the present invention relates to devices used to rapidly cool beverages. More specifically, the present invention relates in part to beverages that are served chilled but generally do not have ice added to them including but not limited to alcoholic beverages such as beer. More generally, the present invention relates to electrical energy saving devices used to cool beverages. More generally, the present invention relates to the efficient storage of foodstuffs.

2. Description of Related Art

The current art contains numerous devices meant to cool liquids. They include for the most part: complex motor driven devices and/or devices that use a coolant and a heat exchange system. The prior art also includes mechanically similar devices that are used to dry washed lettuce leaves, commonly referred to as a "salad spinners" or related devices.

A manually operated device used to cool beverage containers in an ice chest is described in U.S. Pat. No. 4,813,243 to Woods et al. wherein a hand crank operated belt driven system rotates beverage cans on a bed of ice. U.S. Pat. No. 5,282,368 to Ordoukhanian describes a device for rotating a single beverage container inside of an ice chest at an angle. U.S. Pat. No. 4,825,665 to Micallef describes a motorized wine chiller wherein a wine bottle is rotated inside an open container of ice and water. A manual spinning means with a plunger and a helical post is described in U.S. Pat. No. 5,992,309 to Mulhauser et al that claims use for drying rinsed foods by centrifugation. U.S. Pat. No. 6,314,751 to Gjersvik is one of many to disclose a hand crank for rotating a beverage container inside a cooling chamber containing a chilled liquid and requiring vigorous arm/hand motion for an extended period; the device to Gjersvik requires an additional separate chamber for containing ice that is in communication with the cooling liquid.

There does not exist, however, the present invention which is a device that chills a single beverage container of any type very quickly using a cooling means including in part a chilled liquid whereby a user manually operates a plunger-post spinning means that very rapidly rotates a beverage container immersed in the chilled liquid while enclosed inside a single compact cooling chamber of a suitable shape and size for use with the desired beverage container.

SUMMARY OF THE INVENTION

The present invention relates to: beverage cooling devices and methods; energy saving devices and methods; and foodstuff storage devices and methods. The present invention comprises a device whereby a beverage container is placed into a rotatable holding means located inside a cooling chamber. The cooling chamber interior using a cooling means as explained in the detailed description portion of this disclosure. Additionally, the present invention comprises a spinning means whereby the rotatable holding means is spun thereby spinning the beverage container inside said cooling chamber. The liquid inside said beverage container is thereby spun and cooled by rapid quantitative heat exchange with the cooled wall of said chamber.

It is therefore an object of the present invention to cool or chill a beverage inside a beverage container.

It is another object of the present invention to permit chilling of beverages inside containers of any shape and size including but not limited to cans of any length and/or diameter and bottles of any size or shape; relatedly the present object additionally is intended to permit chilling of beverages inside containers made from any material suitable to effecting heat exchange including but not limited to aluminum, steel, alloys of aluminum and/or steel, paper, glass, polyethylene terepthalate and/or any petroleum based material, plant derivatives or products, and any combination thereof.

It is another object of the present invention to permit dry storage of numerous beverage containers outside of an artificially cooled environment whereby a room temperature beverage may be chilled rapidly using the present invention.

It is another object of the present invention to create space inside a refrigerator or similar for the purpose of efficient storage of foodstuffs.

It is another object of the present invention to operate a spinning means manually by hand and thereby conserve electrical energy otherwise consumed to chill a beverage.

It is another object of the present invention to comprise a manually operated spinning means that does not require rapid hand/arm motion for extended periods as is required with other types of manual spinning means.

It is another object of the present invention to permit chilling of beverages where no source of electricity is available for example while camping or boating.

It is another object of the present invention to chill beverages including alcoholic beverages such as beer, to which ice is typically not added and where those beverages are generally served chilled.

The characteristics and utilities of the present invention described in this summary and the detailed description below are not all inclusive. Many additional features and advantages will be apparent to one of ordinary skill in the art given the following description. There has thus been outlined, rather broadly, the more important features of the invention in order that the detailed description thereof that follows may be better understood, and in order that the present contribution to the art may be better appreciated.

In this respect, by explaining at least one embodiment of the invention in detail, it is to be understood that the invention is not limited in its application to the details of construction and to the arrangements of the components set forth in the description. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the description be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, nor is it intended to be limiting as to the scope of the invention in any way.

The characteristics and utilities of the present invention described in this summary and the detailed description below are not all inclusive. Many additional features and advantages will be apparent to one of ordinary skill in the art given the following detailed description.

DETAILED DESCRIPTION

A cooling means is employed to chill the exterior walls of a beverage container. A cooling means may include: adding ice and water to the chamber; use of a coolant material such as ethylene glycol that is stored in the wall of the container and whereby the cooling chamber is stored in a freezer and water added to the chamber for use; a generally cylindrical insert that is separately chilled and inserted into the cooling chamber and water added to the chamber for use; and/or other heat removal means for an insulated chamber that is capable of remaining cool for an extended period of time used with a liquid to chill the exterior walls of a beverage can.

Figure 1:
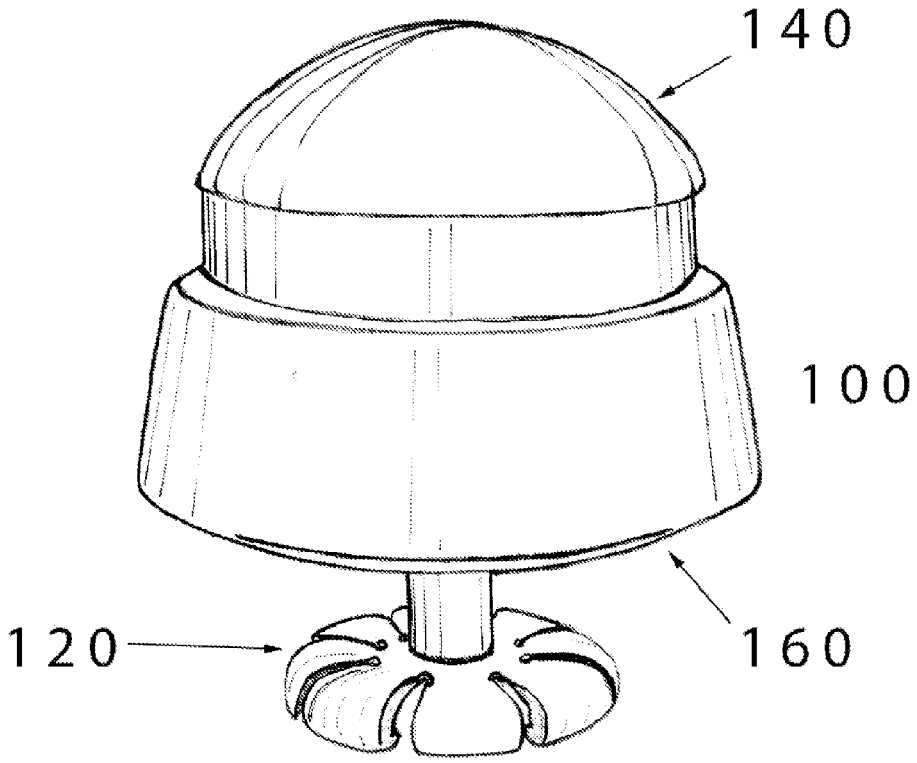
FIG. 1 is a perspective view of the spinning means and shows the collet holding means.
Figure 2:
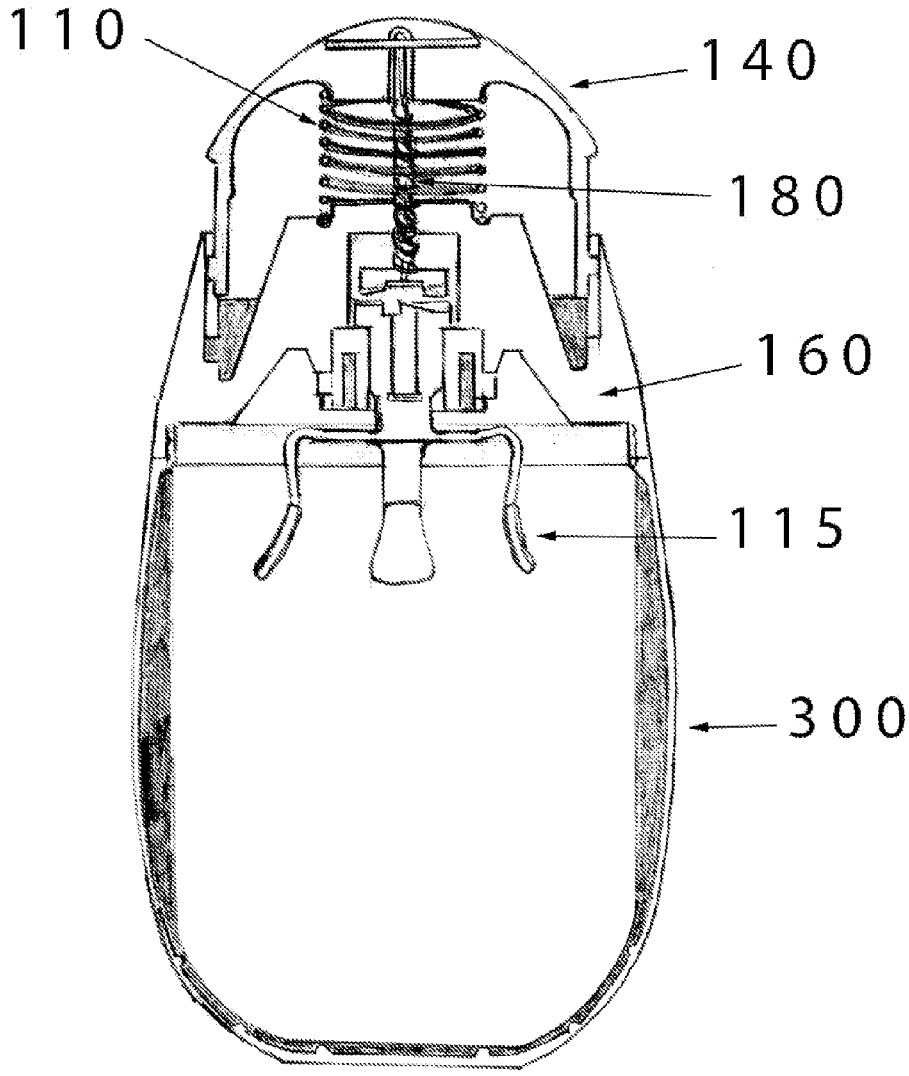
FIG. 2 is a dissected view of the present invention showing the arrangement of the elements including the spinning means, the holding means and the cooling chamber, all as configured for use.
Figure 3:
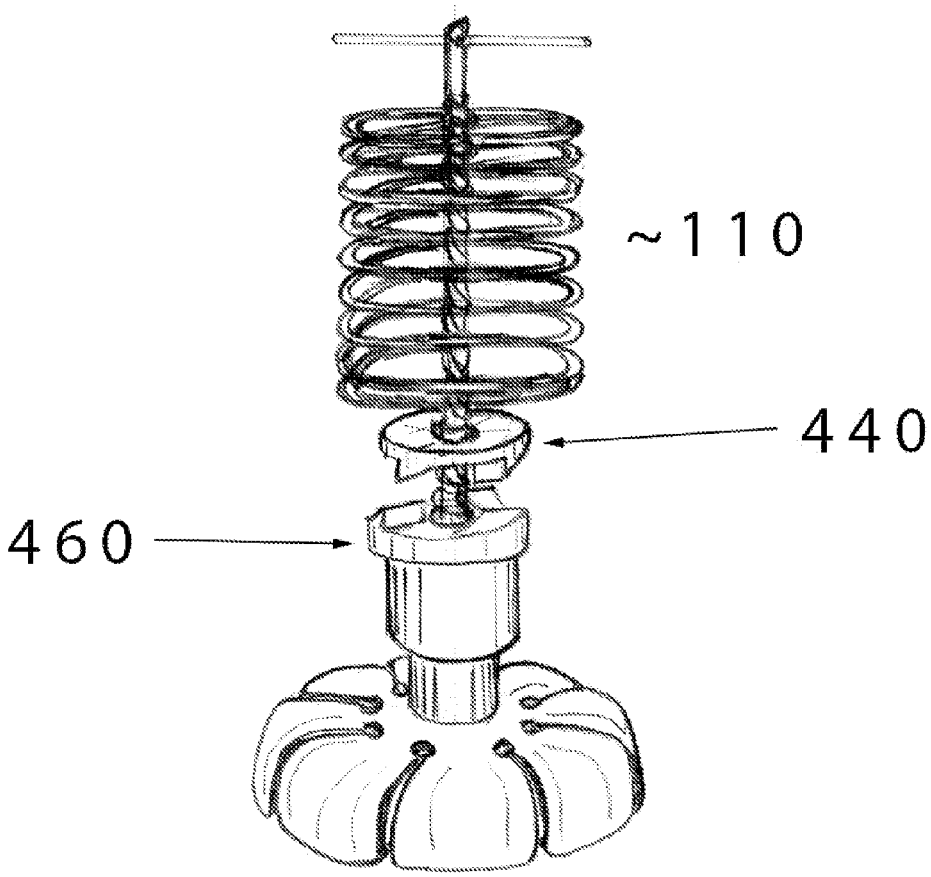
FIG. 3 is a plain view of the spinning means and shows in part the helically biased post passing through the slot in the slotted gear driver and the corresponding gear plate with central opening.

A rotatable holding means is employed to grip a beverage container. In a preferred embodiment, the rotatable holding means comprises a collet 120. Said collet permits insertion of the neck portion of a beverage container whereby said container is held into place by frictional attachment to said collet 120; see FIG. 1. Both cans and bottles are manufactured generally with a lip portion at the neck end whereby said lip portion is of a larger diameter than the neck portion; the collet operates by spreading to allow the lip (an bottle cap as applied) into an internal chamber and holding frictionally the lip and neck in place once the lip is inserted through to the chamber. In an alternative embodiment, said holding means comprises, as a non-limiting example, a plurality of fingers 115 located in a circumferential relationship to one another and forming a closure that flexibly opens to permit insertion of a plurality of beverage container types, including but not limited to, bottles and cans, and thereby causes frictional attachment of said fingers to a beverage container.

The preferred embodiment of the holding means for all beverage containers including but not limited to cans and bottles of any neck diameter is a collet of appropriate depth and diameter; the plurality of fingers 115 described above are an alternative embodiment. It is to be understood that beverage container shapes and sizes vary by beverage type market, market location, and other factors such that the present disclosure is not intended to limit in any way the beverage container shape or size which may be inserted into a holding means whereby the holding means presently disclosed is enabled to hold any can, bottle, and/or any container type of any size or shape for the purposes of the present invention. Furthermore, in order to achieve the purpose(s) of the present invention, the holding means portion may be frictionally attached and detached thereby permitting use of holding means with different depths and diameters.

It is to be further understood that a cooling chamber must be of sufficient dimension to accept a beverage container and that the present disclosure does not limit in any way the useful dimensions of the cooling chamber to achieve the purpose of the present invention.

The plunger portion 140 is selectably locked into a depressed position inside the gear housing for traveling and compactness purposes. An L-shaped groove in the gear housing accepts pin arms extending from the plunger portion whereby the vertical portion of the groove guides vertical travel including while pumping during use, and the horizontal portion of the groove permits turning the plunger and locking it in the depressed position.

Said rotatable holding means further comprises a post attached proximally along its spinning axis, said post terminal end comprising a hollow bushing supporting a gear plate with a central opening included as part of a spinning means 100. Said spinning means comprising a corresponding opposing slotted gear driver, a spring 110 attached to a threaded plunger housing 160, a helically biased post 180, and a plunger portion 140. At rest, the spring is relaxed and the helically biased post terminal end is just through the central slot of the gear driver. Depressing said plunger 140 causes said spring to compress and further causes the remainder of said helically biased post to be forced through the slot in the gear driver 440 thereby causing it to turn unidirectionally and place pressure against the gear teeth of the gear plate 460 attached to the rotatable holding means post terminal end, thereby causing said rotatable holding means to spin along said holding means post and said helically biased post common axis. The helically biased post passes from the slot in the gear driver 440, through the central opening in the gear plate 460, and into the hollow bushing. Release of the plunger causes said spring to force the helically biased post to return through the slotted gear plate 440 while permitting the rotatable holding portion to spin freely.

The present disclosure anticipates other spinning means in the spirit of disclaimers made throughout this application that would enable those skilled in the art to easily modify the present invention. An anticipated alternative spinning means thereby comprises any use of a compressed spring where the potential energy of the compressed spring is used to spin the holding and/or gripping means. Another anticipated alternative spinning means is the use of a hand crank whereby the holding and/or gripping means is/are spun by turning a crank handle which may or may not be used together with the first anticipated alternative spinning means comprising a compressed spring.

In use, ice and water are added to an insulated cooling chamber that includes a means for attaching and detaching at the top end the spinning means, said attaching means including but not limited to a threaded section capable of receiving the threaded plunger housing portion. A beverage container is attached to the holding means via the gripping means and is thereby attached to the spinning means. The spinning means is then attached to the cooling chamber so that said beverage container is inside the cooling chamber and in contact with the ice and water inside. Rotation of a beverage container results in quantitative formation of a vortex inside the can of said liquid beverage. Said vortex permits rapid heat exchange between the cold liquid inside the cooling chamber, the beverage container walls, and the beverage permitting reasonably quick chilling of the beverage.

The previous is a detailed description of embodiments of the present invention. As these embodiments of the present invention are described, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, the description is not to be considered in a limiting sense, as it is understood that the present invention is in no way limited to the embodiments described.

What is claimed is:

1. A device for rapidly cooling a beverage comprising:

a. a cooling chamber, the cooling chamber defining an interior;

b. a rotatable holding element, the holding element comprising a collet, the collet operable to attach to a beverage container; and c. a spinning mechanism, the mechanism operable to attach to the cooling chamber and to rotate the holding element in the interior of the cooling chamber, wherein the spinning mechanism comprises a spring-loaded plunger, wherein the spinning mechanism rotates the holding element in response to depression of the plunger.

2. The device of claim 1, wherein the spinning mechanism generates a fluid vortex in a beverage within a beverage container attached to the holding element.

3. The device of claim 1, wherein the cooling chamber contains a cooling agent.

4. The device of claim 3, wherein the cooling agent comprises a chilled liquid.

5. The device of claim 4, wherein the spinning mechanism generates a fluid vortex in the cooling agent.

6. The device of claim 3, wherein the cooling agent comprises a chilled cylindrical insert.

7. The device of claim 1, wherein the cooling chamber comprises a single-walled container or a double-walled container.

8. The device of claim 1, wherein the beverage container is resealable.

9. The device of claim 1, wherein the collet attaches to a beverage container by one or more circumferentially-arranged flanges interacting with a lip on the top edge of the beverage container.

10. The device of claim 1, wherein the collet attaches to a beverage container by one or more circumferentially-arranged fingers interacting with the top portion of the beverage container.

11. The device of claim 1, wherein the spinning mechanism is human powered.

12. The device of claim 1, wherein the plunger is lockable in a depressed position.

13. The device of claim 1, wherein depression of the plunger drives a helically biased post through a slot in a gear driver to rotate the holding element.

14. The device of claim 1, wherein the spinning mechanism comprises a hand crank.

15. The device of claim 1, wherein the spinning mechanism comprises a spring, the spring compressible to store potential energy used to rotate the holding element.

16. The device of claim 1, wherein the beverage is cooled by about 10, 20, or 30 degrees centigrade within about 30, 60, or 90 seconds of rotation within interior of the cooling chamber.

17. A method of rapidly chilling a beverage, the method comprising:

a. attaching a spinning mechanism to a beverage container, the spinning mechanism comprising a rotatable holding element and a spring-loaded plunger, the rotatable holding element comprising a collet operable to grip the beverage container, wherein the spinning mechanism rotates the holding element in response to depression of the plunger;

b. attaching the spinning mechanism to a cooling chamber defining an interior such that the holding element, the collet, and the beverage container are positioned within the interior of the cooling chamber, the interior of the cooling chamber containing a cooling agent; and c. activating the spinning mechanism to generate a fluid vortex in the beverage within the beverage container, the vortex reducing the time required to chill the beverage.

18. A device for rapidly cooling a beverage comprising:

a. a cooling chamber, the cooling chamber defining an interior;

b. a rotatable holding element, the holding element comprising a collet, the collet operable to attach to a beverage container; and c. a spinning mechanism, the mechanism operable to attach to the cooling chamber and to rotate the holding element in the interior of the cooling chamber, wherein the spinning mechanism comprises a spring-loaded plunger, wherein the plunger is lockable in a depressed position.

19. The device of claim 18, wherein the spinning mechanism generates a fluid vortex in a beverage within a beverage container attached to the holding element.

20. The device of claim 18, wherein the cooling chamber contains a cooling agent.

* * * * *